US009666168B2

(12) United States Patent
Soga et al.

(10) Patent No.: US 9,666,168 B2
(45) Date of Patent: May 30, 2017

(54) BOARD FOR STRINGED INSTRUMENT, METHOD OF MANUFACTURING BOARD FOR STRINGED INSTRUMENT, AND STRINGED INSTRUMENT

(71) Applicant: Yamaha Corporation, Hamamatsu-Shi, Shizuoka-Ken (JP)

(72) Inventors: Kazuki Soga, Hamamatsu (JP); Toshihisa Yamazaki, Hamamatsu (JP); Tatsuya Hiraku, Hamamatsu (JP); Hiroshi Nakaya, Hamamatsu (JP); Kenichi Miyazawa, Fukuroi (JP)

(73) Assignee: Yamaha Corporation, Hamamatsu (JP)

( * ) Notice: Subject to any disclaimer, the term of this patent is extended or adjusted under 35 U.S.C. 154(b) by 54 days.

(21) Appl. No.: 14/518,133

(22) Filed: Oct. 20, 2014

(65) Prior Publication Data

US 2015/0107435 A1 Apr. 23, 2015

(30) Foreign Application Priority Data

Oct. 22, 2013 (JP) ..... 2013-219354

(51) Int. Cl.

| | |
|---|---|
| ***G10D 3/00*** | (2006.01) |
| ***G10D 1/00*** | (2006.01) |
| ***G10D 1/02*** | (2006.01) |
| ***G10D 3/02*** | (2006.01) |

(52) U.S. Cl.

CPC ..... *G10D 1/005* (2013.01); *G10D 1/02* (2013.01); *G10D 3/00* (2013.01); *G10D 3/02* (2013.01); *Y10T 29/49574* (2015.01)

(58) Field of Classification Search

USPC ..... 84/291

See application file for complete search history.

(56) References Cited

U.S. PATENT DOCUMENTS 3,699,836 A * 10/1972 Glasser ..... G10D 1/005 84/275
4,334,452 A * 6/1982 Morrison, III ..... G10D 1/085 84/267
5,333,527 A * 8/1994 Janes ..... B29C 70/083 156/245

(Continued)

FOREIGN PATENT DOCUMENTS

| | | |
|---|---|---|
| GB | 1 329 817 | 4/1971 |
| GB | 1 329 817 | 9/1973 |
| JP | B-26-003926 | 7/1951 |
| JP | U-54-117225 | 8/1979 |
| JP | 2011-207159 A | 10/2011 |

OTHER PUBLICATIONS

"The Encyclopedia: VIOLIN"; p. 201-203, published by Tokyo Ongaku-sha, issued on Dec. 25, 1992.

Search Report, EP 14189496.4, Feb. 25, 2015.

Office Action issued in Japanese Patent Application No. 2013-219354, mailed on Jun. 21, 2016.

Office Action from JP Application No. 2013-219354 issued on Jan. 17, 2017.

*Primary Examiner* — Christopher Uhlir

(74) *Attorney, Agent, or Firm* — Blank Rome LLP

(57) ABSTRACT

A board for a stringed instrument which forms a front plate or a back plate of a stringed instrument, includes: a laminated plate that is obtained by laminating a plurality of veneers having a uniform thickness by an adhesive, at least one of the veneers having a different planar shape than the other veneers, in which the laminated plate is curved to be convex toward one surface side and has a thin portion and a thick portion.

5 Claims, 4 Drawing Sheets

(56) References Cited

U.S. PATENT DOCUMENTS 5,955,688 A * 9/1999 Cook ..... G10D 1/005 84/291
6,107,552 A * 8/2000 Coomar ..... G10C 3/06 84/192
6,372,970 B1 * 4/2002 Saunders, Jr. ..... G10D 1/005 84/290
6,639,135 B1 * 10/2003 Lucas ..... B27D 1/08 84/291
6,664,452 B1 * 12/2003 Teel ..... G10D 3/02 84/267
6,770,804 B2 * 8/2004 Schleske ..... G10C 3/06 81/311
7,208,665 B2 * 4/2007 Schleske ..... G10D 3/02 84/275
7,786,361 B1 * 8/2010 Foltz ..... G10D 1/005 84/267
8,729,371 B2 * 5/2014 Yokoyama ..... G10D 1/00 84/173
2005/0223871 A1 10/2005 Allred, III
2006/0272470 A1 * 12/2006 Parker ..... G10D 1/005 84/291

* cited by examiner

BOARD FOR STRINGED INSTRUMENT, METHOD OF MANUFACTURING BOARD FOR STRINGED INSTRUMENT, AND STRINGED INSTRUMENT

BACKGROUND OF THE INVENTION

Field of the Invention

The present invention relates to a board for a stringed instrument, a method of manufacturing a board for a stringed instrument, and a stringed instrument.

Priority is claimed on Japanese Patent Application No. 2013-219354, filed on Oct. 22, 2013, the content of which is incorporated herein by reference.

Description of Related Art

Front and back plates of a violin have partially different thicknesses so as to obtain satisfactory acoustic characteristics and have a unique camber shape of being gently curved to be convex toward a front or back surface side thereof. Front and back plates used in a viola, a cello, and a double bass belonging to the violin family also have a camber shape having partially different thicknesses as in the case of a violin.

In the related art, during the manufacture of front and back plates of the violin family, a solid wooden block is cut or carved to be formed in a camber shape having partially different thicknesses. However, when a solid wooden block is cut to manufacture front and back plates, there are problems in that much time and labor are required due to a significantly large number of cutting processes, and the material yield is extremely low at about 10%.

Recently, as front and back plates of the violin family, plates in which a camber shape having partially different thicknesses is formed by press-bending a board having a smaller thickness than a wooden block to partially compress and curve the board have been manufactured (refer to p. 203, "VIOLIN, Instrument Encyclopedia", published by Tokyo Ongaku-sha).

In addition, front and back plates of the violin family can also be manufactured by laminating a plurality of veneers adhered to each other by an adhesive to obtain laminated wood and bending the laminated wood to be gently curved.

In the front and back plates, since a camber shape is formed by bending, the number of cutting processes for forming the camber shape can be reduced. Accordingly, these front and back plates can be more efficiently manufactured as compared to the plates manufactured by cutting a wooden block, and the material yield is also improved.

However, in the front and back plates formed by press-bending a board, the thicknesses thereof are made to be partially different and a predetermined thickness distribution is formed by partially compressing the board. Therefore, the wood density in the compressed portion increases, and a variation in density is significantly large in the front and back plates. Even if front and back plates of the violin family have a unique camber shape, when a variation in density is large, a vibration during playing is different from the unique vibration of the violin family. Therefore, in a stringed instrument including a front plate and/or a back plate formed by press-bending, satisfactory acoustic characteristics may not be obtained.

In addition, in the front and back plates formed by press-bending, after the manufacture, a thickness distribution and a camber shape thereof are likely to be changed by a restoring force of compressed wood. Therefore, when a stringed instrument including the front and back plates formed by press-bending is used for a long period of time, acoustic characteristics may deteriorate, or there may be a damage caused by deformation of the front plate and/or the back plate.

On the other hand, in the front and back plates in which a camber shape is formed by bending laminated wood, the laminated wood is not partially compressed during the manufacture, and thus a variation in density is small. Accordingly, the above-described problems caused by the density in the front and back plates do not occur.

However, these front and back plates are uniform in thickness. Therefore, in a stringed instrument including these front and back plates, a vibration of the front and back plates during playing is different from the unique vibration of the violin family, and satisfactory acoustic characteristics may not be obtained.

In addition, there may be a case where a camber shape having partially different thicknesses is formed by press-bending laminated wood. However, in this case, since the laminated wood is partially compressed by press-bending, a variation in density is large in the front and back plates.

In addition, there may be a case where a camber shape having partially different thicknesses is formed by cutting laminated wood before or after bending the laminated wood. However, when the laminated wood is cut, a laminated cross-section is exposed to the surface, and a good appearance cannot be obtained.

SUMMARY OF THE INVENTION

The present invention has been made in consideration of the above-described circumstances, and an object thereof is to provide a board for a stringed instrument which can be efficiently manufactured, has high material yield, has a small variation in density, has partially different thicknesses, has a shape of being curved to be convex toward one surface side thereof, and forms a front plate or a back plate having superior shape stability and acoustic characteristics.

In addition, another object of the present invention is to provide a stringed instrument which is not likely to be damaged by deformation of a front plate and/or a back plate and is superior in acoustic quality, the stringed instrument including a front plate and/or a back plate made of a board for a stringed instrument which can be efficiently manufactured and has high material yield.

According to an aspect of the present invention, there is provided a board for a stringed instrument which forms a front plate or a back plate of a stringed instrument, the board including: a laminated plate that is obtained by laminating a plurality of veneers having a uniform thickness, the veneers being adhered to each other by an adhesive without a gap, at least one of the veneers having a different planar shape than the other veneers, in which the laminated plate is curved to be convex toward one surface side and has a thin portion and a thick portion.

According to another aspect of the present invention, there is provided a method of manufacturing a board for a stringed instrument which forms a front plate or a back plate of a stringed instrument, the method including: a laminating process of forming a laminate by laminating a plurality of veneers having a uniform thickness by an adhesive, at least one of the veneers having a different planar shape than the other veneers; and a bending process of obtaining a laminated plate by curving the laminate to be convex toward one surface side and forming a thin portion and a thick portion while maintaining the thickness of each of the plurality of veneers to be constant.

According to still another aspect of the present invention, there is provided a stringed instrument including the board for a stringed instrument according to the aspect of the present invention.

The board for a stringed instrument according to the aspect of the present invention includes a laminated plate that is obtained by laminating a plurality of veneers having a uniform thickness and adhered to each other by an adhesive without a gap. Therefore, in the board for a stringed instrument according to the aspect of the present invention, partial compression of wood for allowing the thicknesses thereof to be partially different is not performed, and thus a variation in density is small. Further, in the board for a stringed instrument according to the aspect of the present invention, the laminated plate is curved to be convex toward one surface side and has a thin portion and a thick portion. Accordingly, when the board for a stringed instrument according to the aspect of the present invention is used as a front plate or a back plate, the unique vibration of the violin family is obtained during playing, and acoustic characteristics are superior.

In addition, in the board for a stringed instrument according to the aspect of the present invention, a variation in density is small, and a part of the laminated plate is not compressed. Therefore, a thickness distribution is not changed by a restoring force of wood. Further, the board for a stringed instrument according to the aspect of the present invention includes a laminated plate that is obtained by laminating a plurality of veneers having a uniform thickness and adhered to each other by an adhesive without a gap. As a result, deformation of the laminated plate is suppressed by the adhesive. Therefore, the board for a stringed instrument according to the aspect of the present invention is superior in shape stability as compared to front and back plates of the related art formed by press-bending.

In addition, in the board for a stringed instrument according to the aspect of the present invention, the laminated plate is curved to be convex toward one surface side and has a thin portion and a thick portion. As a result, it is not necessary to perform cutting for forming a camber shape. Accordingly, in the board for a stringed instrument according to the aspect of the present invention, the number of cutting or carving processes can be reduced as compared to a front plate and a back plate manufactured by cutting or carving a wooden block. As a result, these front and back plates can be more efficiently manufactured as compared to the plates manufactured by cutting or carving a wooden block, and the material yield is also improved.

The method of manufacturing a board for a stringed instrument according to the aspect of the present invention includes: a laminating process of forming a laminate by laminating a plurality of veneers having a uniform thickness and adhered by an adhesive, at least one of the veneers having a different planar shape than the other veneers; and a bending process of obtaining a laminated plate by curving the laminate to be convex toward one surface side and forming a thin portion and a thick portion while maintaining a constant thickness of each of the plurality of veneers. Accordingly, a board for a stringed instrument having a small variation in density, partially different thicknesses, and a shape of being curved to be convex toward one surface side can be obtained without partially compressing wood. In addition, in the method of manufacturing a board for a stringed instrument according to the aspect of the present invention, a board for a stringed instrument can be efficiently manufactured with a small number of cutting processes as compared to a case where cutting for forming a camber shape is performed.

In addition, the stringed instrument according to the aspect of the present invention includes the board for a stringed instrument according to the aspect of the present invention. As a result, the acoustic quality is superior. In addition, the stringed instrument according to the aspect of the present invention is not likely to be damaged by deformation of a front plate and a back plate and thus can be used for a long period of time.

DETAILED DESCRIPTION OF THE INVENTION

Hereinafter, embodiments of the present invention will be described with reference to the drawings.

<First Embodiment>

Figure 1A:
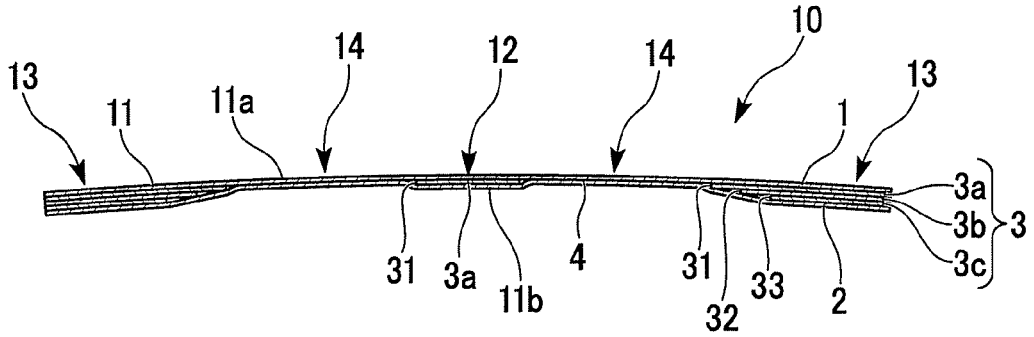
FIG. 1A is a cross-sectional view showing a front plate of a violin according to a first embodiment of the present invention in a width direction thereof (a cross-sectional view taken along line A-A' of FIG. 1B)
Figure 1B:
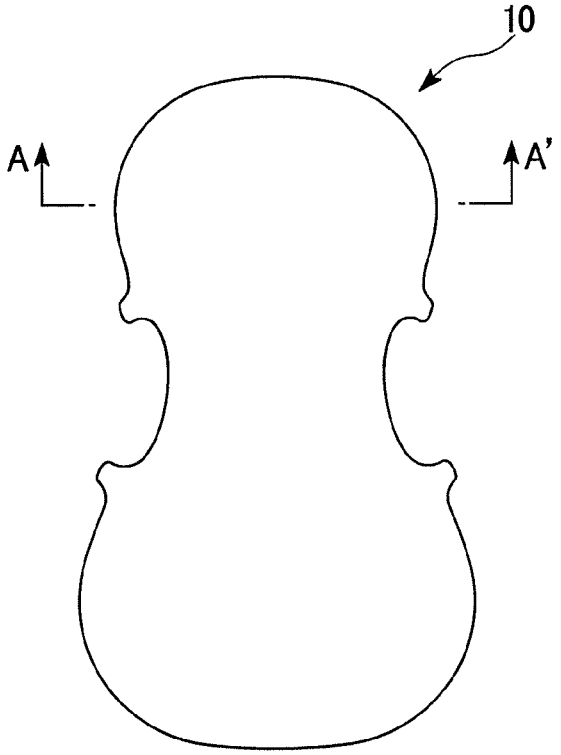
FIG. 1B is a plan view showing the front plate shown in FIG. 1A.

In this embodiment, a front plate of a violin will be described as an example of a board for a stringed instrument according to the present invention. FIG. 1A is a cross-sectional view showing a front plate of a violin according to a first embodiment of the present invention in a width direction thereof. FIG. 1B is a plan view showing the front plate shown in FIG. 1A. FIG. 1A is a cross-sectional view taken along line A-A' of FIG. 1B As shown in FIG. 1A, the front plate 10 of the violin includes a laminated plate 11 having a camber shape which is curved to be convex toward the side of a front surface 11*a* (top surface in FIG. 1A).

The laminated plate 11 is partially different in thickness as shown in FIG. 1A. Regarding the thickness of the laminated plate 11, the thickness of peripheral edges 13 is the thickest, the thickness of a center portion 12 is the second thickest, and thin portions 14 are formed between the center portion 12 and the peripheral edges 13. As shown in FIG. 1A, the thickness of the laminated plate 11 gradually changes, and the front surface 11*a* and a back surface 11*b* are gently curved.

The laminated plate 11 includes a front surface plate 1, a back surface plate 2, a core plate 3 that is arranged between the front surface plate 1 and the back surface plate 2. The core plate 3 includes a first core plate 3*a*, a second core plate 3*b*, and a third core plate 3*c* that are laminated in this order from the front surface plate 1. The front surface plate 1, the back surface plate 2, and the first to third core plates 3*a*, 3*b*, and 3*c* are veneers made of wood and having a uniform thickness. The plates 1, 2, 3*a*, 3*b*, and 3*c* are laminated and adhered to each other by an adhesive 4 without a gap.

The front surface plate 1 exposed to the front surface 11*a* of the laminated plate 11 and the back surface plate 2 exposed to the back surface 11*b* of the laminated plate 11 have a continuous plane having the same shape as an external shape of the front plate 10 shown in a plan view of FIG. 1B. That is, the entire surface of the front surface 11*a* of the front plate 10 is covered with the front surface plate 1, and the entire surface of the back surface 11*b* of the front plate 10 is covered with the back surface plate 2.

The front surface plate 1 of the front plate 10 may have a continuous plane which is integrated by aligning end surfaces of two veneers to face each other at a center portion in a length direction of the front plate 10 and joining the end surfaces to each other. As a result, a good appearance having a joint at the center portion in the length direction of the front plate 10 is obtained.

In this embodiment, the first to third three core plates 3*a*, 3*b*, and 3*c* which form the core plate 3 have a different planar shape from the front surface plate 1 and the back surface plate 2.

As shown in FIG. 1A, holes 31 are formed in a region where the first core plate 3*a* overlaps the thin portions 14 in a plan view. In addition, as shown in FIG. 1A, a hole 32 is formed in a region where the second core plate 3*b* overlaps the thin portions 14 and the center portion 12 in a plan view. That is, the second core plate 3*b* is arranged in a planar frame shape in only a region overlapping the peripheral edges 13. In addition, a hole 33 is formed in a region where the third core plate 3*c* overlaps the thin portions 14 and the center portion 12 in a plan view. That is, the third core plate 3*c* is arranged in a planar frame shape in only a region overlapping the peripheral edges 13. As shown in FIG. 1A, the hole 33 formed in the third core plate 3*c* has a larger planar shape than the hole 32 formed in the second core plate 3*b*. The contour of the hole 33 of the third core plate 3*c* is arranged outside the contour of the hole 32 of the second core plate 3*b* in a plan view.

The planar shapes of the first to third core plates 3*a*, 3*b*, and 3*c* which form the core plate 3 are determined according to a predetermined thickness distribution in consideration of a function of the front plate 10 as a vibrating plate. That is, by allowing the planar shapes of the first to third core plates 3*a*, 3*b*, and 3*c* to be different from each other, the numbers of laminated veneers are allowed to be different from each other, and the thickness distribution of the front plate 10 is formed.

In the thickest portions which are the peripheral edges 13 of the laminated plate 11 shown in FIG. 1A, the number of laminated veneers, which are the front surface plate 1, the back surface plate 2, and the first to third core plates 3*a*, 3*b*, and 3*c*, is 5. In addition, in the peripheral edges 13, the number of laminated veneers is reduced from 5 to 3 toward the thin portions 14. In the thin portions 14, the core plate 3 is not arranged, and the number of laminated veneers, which are the front surface plate 1 and the back surface plate 2, is 2. In addition, in the center portion 12, the number of laminated veneers, which are the front surface plate 1, the back surface plate 2, and the first core plate 3*a*, is 3.

In the front plate 10 shown in FIG. 1A, the thicknesses of the veneers used in the front surface plate 1, the back surface plate 2, and the first to third core plates 3*a*, 3*b*, and 3*c* are preferably 0.1 mm to 1.5 mm. The thicknesses of the veneers of the front surface plate 1, the back surface plate 2, and the first to third core plates 3*a*, 3*b*, and 3*c* may be the same as or different from each other. Veneers having a thickness of 0.1 mm or more are preferable due to its availability. In addition, when the thicknesses of the veneers are 0.1 mm or more, even if the adhesive infiltrates into the veneers during the manufacture of the laminated plate 11, the veneers are not likely to be deformed. Therefore, the thickness distribution of the laminated plate 11 can be controlled with higher accuracy. In order to prevent the deformation of the veneers and to control the thickness distribution of the laminated plate 11 with higher accuracy, the thicknesses of the veneers are more preferably 0.3 mm or more. In addition, when the thicknesses of the veneers are 1.5 mm or less, the thickness of the laminated plate 11 can be controlled using the plurality of veneers with higher accuracy. In order to secure the number of veneers and to control the thickness distribution of the laminated plate 11 with higher accuracy, the thicknesses of the veneers are more preferably 1.0 mm or less.

The thicknesses of the veneers used in the front surface plate 1 are more preferably 0.3 mm to 1.5 mm. When the thickness of the front surface plate 1 is 0.3 mm or more, the adhesive 4 can be prevented from infiltrating into the front surface 11*a* of the laminated plate 11, and a better appearance can be obtained. In addition, when the thickness of the front surface plate 1 is 0.3 mm or more, a cutting stock of the front surface 11*a* of the laminated plate 11 can be sufficiently secured. Therefore, even if the thickness distribution of the front substrate 10 is finely adjusted or convex and concave portions present on the front surface 11*a* of the front plate 10 are removed by cutting the front surface 11*a* of the laminated plate 11 using, for example, a scraper, a laminated cross-section of the laminated plate 11 of the front surface 11*a* can be prevented from being exposed. In addition, the thickness of the front surface plate 1 is preferably 0.3 mm or more because a step which is formed by different numbers of laminated veneers can be prevented from being taken over to a front surface 11*a* of the front plate 10.

The back surface plate 2 is formed such that the first to third core plates 3*a*, 3*b*, and 3*c* are interposed between the front surface plate 1 and the back surface plate 2, reinforces the laminated plate 11, prevents deformation of the laminated plate 11, and has a function of improving the shape stability of the front plate 10. When the thicknesses of the veneers used in the back surface plate 2 are 0.3 mm or more, the function of improving the shape stability of the front plate 10 can be more efficiently obtained.

Materials of the veneers of the front surface plate 1, the back surface plate 2, and the first to third core plates 3*a*, 3*b*, and 3*c* may be the same as or different from each other. As the materials of the veneers, for example, spruce, maple, pine, Japanese cedar, birch, beech, or lauan may be used. Among these, spruce is preferably used because a high function of the front plate 10 as a vibrating plate can be obtained. Further, it is preferable that all of the front surface plate 1, the back surface plate 2, and the first to third core plates 3*a*, 3*b*, and 3*c* in the front plate 10 be made of spruce. By allowing all the veneers to be made of spruce, a higher function as the front plate 10 can be obtained, and the acoustic quality of a violin using this front plate 10 can be further improved. In addition, in the front plate 10 according to the embodiment, a better appearance can be obtained by using straight-grained spruce as the materials of the veneers which form the front surface plate 1.

Fiber directions of the veneers of the front surface plate 1, the back surface plate 2, and the first to third core plates 3*a*, 3*b*, and 3*c* may be the same as or different from each other. It is preferable that the fiber directions of the veneers be aligned to the length direction of the front plate 10 in consideration of a function of the front plate 10 as a vibrating plate. It is preferable that the fiber directions of the veneers used in the front surface plate 1 be aligned to the length direction of the front plate 10 in consideration of the appearance of the front plate 10. In addition, it is preferable that the fiber directions of the veneers include the length direction and the width direction of the front plate 10 in consideration of the strength and shape stability of the front plate 10.

As the adhesive 4, one not containing a solvent such as water or an organic solvent is preferably used. Specifically, examples of the adhesive 4 not containing a solvent include a urethane-based adhesive, an epoxy-based adhesive, and a phenol-based adhesive.

By using the adhesive not containing a solvent, deformation of the veneers caused by infiltration of an adhesive into the veneers can be prevented during the manufacture of the laminated plate 11. Accordingly, the thickness distribution of the laminated plate 11 can be controlled with higher accuracy. As the thicknesses of the veneers decrease, deformation of the veneers caused by infiltration of an adhesive into the veneers is more likely to occur. When the adhesive not containing a solvent is used, deformation of the veneers can be prevented during the manufacture of the laminated plate 11. Therefore, thin veneers can be more easily used. Accordingly, using a plurality of thin veneers, the thickness distribution of the laminated plate 11 can be controlled with higher accuracy.

(Manufacturing Method)

In this embodiment, a method of manufacturing the front plate of the violin shown in FIGS. 1A and 1B will be described as an example of a method of manufacturing a board for a stringed instrument according to the present invention.

Figure 2:
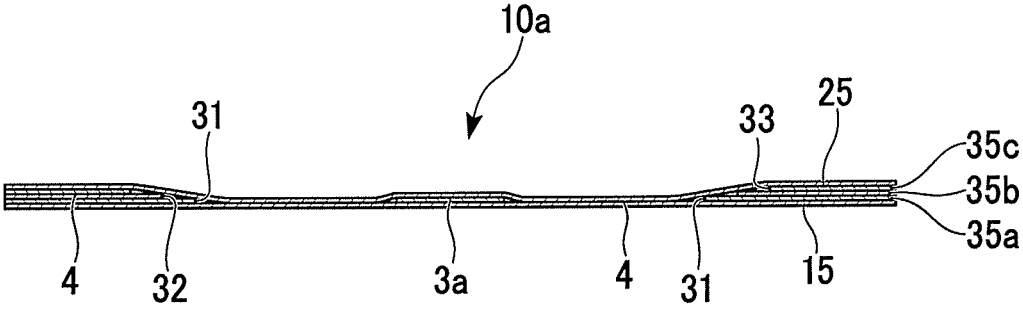
FIG. 2 is a cross-sectional view showing a method of manufacturing the front plate shown in FIGS. 1A and 1B.

FIG. 2 is a cross-sectional view showing a method of manufacturing the front plate shown in FIGS. 1A and 1B. In order to manufacture the front plate 10 shown in FIGS. 1A and 1B, first, the veneers having a uniform thickness including the front surface plate 1, the first to third core plates 3*a*, 3*b*, and 3*c*, and the back surface plate 2 are laminated through the adhesive 4 to obtain a laminate 10*a* shown in FIG. 2 (laminating process).

FIGS. 3A to 3E are plan views showing veneers which are used in the laminate 10*a* shown in FIG. 2. FIG. 2 is a cross-sectional view taken along line B-B' of FIG. 3E.

Figure 3A:
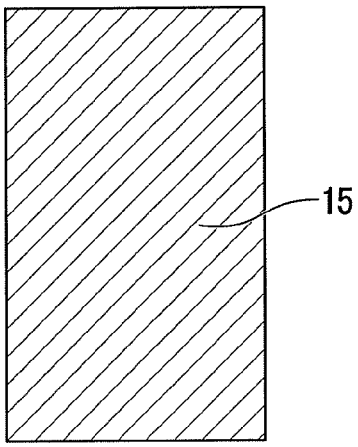
FIGS. 3A to 3E are plan views showing veneers which are used in the front plate shown in FIG. 2.

FIG. 3A is a plan view showing a veneer 15 which is to form the front surface plate 1. The veneer 15 has a rectangular planar shape and is larger than the external shape of the front plate 10 shown in FIG. 1B. The veneer 15 may form a continuous plane which is integrated by aligning end surfaces of two veneers to face each other at a center portion in a length direction of the front plate 10 and joining the end surfaces to each other.

Figure 3B:
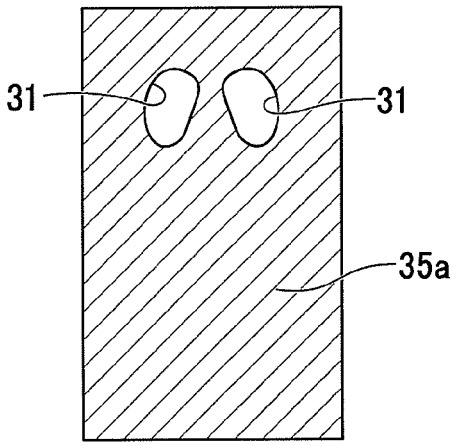
Figure 3C:
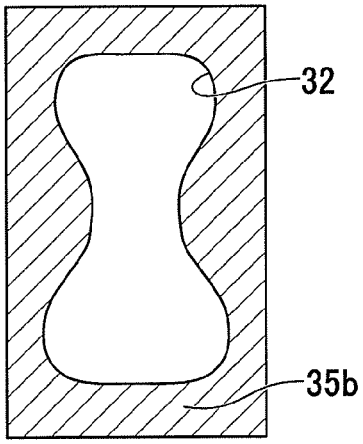
Figure 3D:
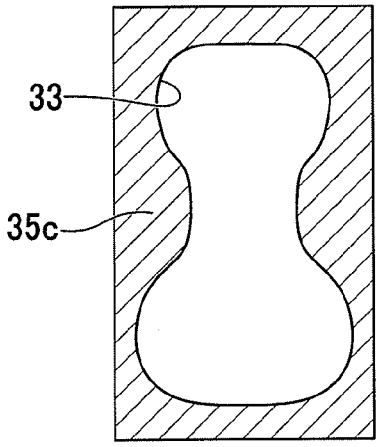
Figure 3E:
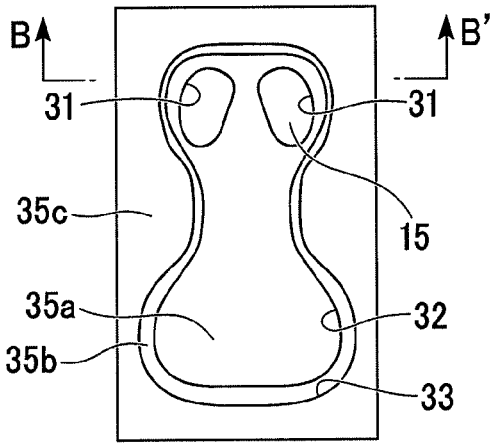

FIG. 3B is a plan view showing a veneer 35*a* which is to form the first core plate 3*a*, FIG. 3C is a plan view showing a veneer 35*b* which is to form the second core plate 3*b*, and FIG. 3D is a plan view showing a veneer 35*c* which is to form the third core plate 3*c*. FIG. 3E is a plan view showing a state where the four veneers 15, 35*a*, 35*b*, and 35*c* are laminated in this order from below. As shown in FIG. 3E, the veneers 15, 35*a*, 35*b*, and 35*c* have different planar shapes and the same external shape.

As shown in FIGS. 2, 3B, and 3E, the two holes 31 are formed on the veneer 35*a* which is to form the first core plate 3*a*. In addition, as shown in FIGS. 2, 3C, and 3E, the hole 32 is formed on the veneer 35*b* which is to form the second core plate 3*b*, and the planar shape of the veneer 35*b* is a frame shape. As shown in FIGS. 2, 3D, and 3E, the hole 33 is formed on the veneer 35*c* which is to form the third core plate 3*c*. As shown in FIGS. 2 and 3E, the hole 33 of the veneer 35*c* has a larger planar shape than the hole 32 of the veneer 35*b*. The contour of the hole 33 is arranged outside the contour of the hole 32 in a plan view.

The first to third core plates 3*a*, 3*b*, and 3*c* can be obtained by forming the holes 31, 32, and 33 using, for example, a punching method at predetermined positions of the veneer 15 which is to form the front surface plate 1.

In order to form the laminate 10*a* shown in FIG. 2, first, the veneer 15 which is to form the front surface plate 1 is arranged on the outermost surface (bottom surface in FIG. 2) of the laminate 10*a* which is to form the front surface 11*a* of the laminated plate 11 shown in FIG. 1A. Next, as shown in FIG. 3E, the veneers 35*a*, 35*b*, and 35*c* are laminated on the veneer 15 through the adhesive 4. Further, as shown in FIG. 2, the veneer 25, which is to form the back surface plate 2, having the same planar shape of the veneer 15 which is to form the front surface plate 1 is arranged on the veneer 35*c* through the adhesive 4, thereby obtaining the laminate 10*a*.

In the laminate 10*a* shown in FIG. 2, the first to third core plates 3*a*, 3*b*, and 3*c* have the holes 31, 32, and 33, respectively. Therefore, as shown in FIG. 2, the numbers of laminated veneers are partially different.

As the adhesive 4, as described above, an adhesive not containing a solvent such as a urethane-based adhesive, an epoxy-based adhesive, or a phenol-based adhesive is preferably used. As the adhesive 4, a thermal adhesive sheet may also be used.

Next, the laminate 10*a* shown in FIG. 2 is placed inside a cavity of a metal mold. As the metal mold, one in which an inside shape of the cavity corresponds to the cross-sectional shape of the front plate 10 is used. Using this metal mold, the laminate 10*a* in which the numbers of laminated veneers among the veneers 15, 35*a*, 35*b*, 35*c*, and 25 are partially different according to the thickness distribution is curved to be convex toward the front surface side. As a result, a thin portion and a thick portion can be formed while maintaining the thickness of each of the veneers to be constant (bending process).

It is preferable that the bending process be performed under a condition where a compressive stress is not applied to the veneers which form the laminated plate 11. By bending the laminate 10*a* under the condition where a compressive stress is not applied to the veneers which form the laminated plate 11, the laminated plate 11 has a uniform density similar to the density intrinsic to wood which forms the veneers. As a result, deformation of the laminated plate 11 can be further suppressed, and the front plate 10 can obtain superior acoustic characteristics intrinsic to wood.

In addition, a temperature condition of the bending process is not particularly limited and can be appropriately determined according to the kind of the adhesive to be used. When a thermoset adhesive is used, it is preferable that the adhesive be cured during the bending process by performing the bending process while performing a heat treatment.

Next, the obtained laminated plate 11 is cut using, for example, a saw along a visible outline (not shown) of the front plate 10 which is positioned outside the contour of the hole 33 of the veneer 35*c* in a plan view, thereby obtaining the front plate 10 having a predetermined external shape shown in FIG. 1B.

Next, optionally, a finishing process may be performed in which the thickness distribution of the front substrate 10 is finely adjusted or convex and concave portions present on the front surface 11*a* of the front plate 10 are removed by cutting the front surface 11*a* of the laminated plate 11 using, for example, a scraper.

Through the above-described processes, the front plate 10 shown in FIGS. 1A and 1B is obtained.

The front plate 10 shown in FIG. 1A includes the laminated plate 11 that is obtained by laminating the plural veneers (the front surface plate 1, the back surface plate 2, and the first to third core plates 3*a*, 3*b*, and 3*c*) having a uniform thickness through the adhesive 4 without a gap. At least one of the plurality of veneers has a different planar shape than the other veneers. The laminated plate 11 is curved to be convex toward the side of the front surface 11*a* and has the thin portion and the thick portion. In this way, in the board for a stringed instrument, the front surface plate 1, the back surface plate 2, and the first to third core plates 3*a*, 3*b*, and 3*c* are uniform in thickness, partial compression of wood as the board for allowing the thicknesses thereof to be partially different is not performed, and the variation in thickness is small.

Further, the front plate 10 shown in FIG. 1A is curved to be convex toward the side of the front surface 11*a* and has the thin portion and the thick portion. Accordingly, when the front plate 10 shown in FIG. 1A is used as a front plate of a violin, the unique vibration of the violin family during playing can be obtained, and superior acoustic characteristics can be obtained.

In addition, since the front plate 10 shown in FIG. 1A is formed without compressing a part of the laminated plate, a variation in density is small. Therefore, unlike a case where a thickness distribution is formed by compressing a part of the laminated plate, a thickness distribution is not changed by a restoring force of wood. Further, the front plate 10 shown in FIG. 1A includes the laminated plate 11 that is obtained by laminating the plural veneers having a uniform thickness through the adhesive 4 without a gap. As a result, the veneers are fixed to each other through the adhesive 4, and thus deformation of the laminated plate 11 is suppressed.

In addition, in the front plate 10 shown in FIG. 1A, the veneer (front surface plate 1) exposed to the front surface 11*a* of the laminated plate 11 has a continuous plane having the same shape as the external shape of the front plate 10 in a plan view. Accordingly, by using a material having superior design characteristic as a material of the front surface plate 1, a good appearance can be obtained.

In addition, the front plate 10 shown in FIG. 1A has a thickness distribution and is curved to be convex toward the front surface side. Therefore, it is not necessary to perform cutting for forming a camber shape. Accordingly, the laminated cross-section of the laminated plate is not exposed to the surface by cutting for forming a camber shape. Therefore, a good appearance can be obtained. In addition, since it is not necessary to perform cutting for forming a camber shape, the material yield is high, and the front plate 10 can be efficiently manufactured with a small number of cutting processes.

The method of manufacturing the front plate 10 shown in FIG. 1A includes: the laminating process of forming the laminate 10*a* by laminating the plural veneers 15, 35*a*, 35*b*, 35*c*, and 25 having a uniform thickness, at least one of which has a different planar shape than the other veneers, through the adhesive 4; and the bending process of obtaining the laminated plate 11 by curving the laminate 10*a* to be convex toward one surface side and forming the thin portion and the thick portion while maintaining the thickness of each of the plural veneers to be constant. Accordingly, the laminated plate 11 having a small variation in density, partially different thicknesses, and a shape of being curved to be convex toward one surface side can be obtained without partially compressing wood. In addition, in the method of manufacturing a board for a stringed instrument according to the aspect of the present invention, a board for a stringed instrument can be efficiently manufactured with a small number of cutting processes as compared to a case where cutting for forming a camber shape is performed.

<Second Embodiment>

In this embodiment, a back plate of a violin will be described as an example of a board for a stringed instrument according to the present invention.

The back plate of the violin according to the embodiment is different from the front plate 10 according to the first embodiment shown in FIG. 1A, in that: planar shapes of the veneers which form the core plate are determined according to a thickness distribution in consideration of a function as the back plate; and it is preferable that maple be used as the materials of the front surface plate, the back surface plate, and the core plate.

In the back plate according to the embodiment, it is more preferable that all of the front surface plate, the back surface plate, and the core plate be made of maple. By allowing all the veneers to be made of maple, a higher function as the back plate can be obtained, and the acoustic quality of a violin using this back plate can be further improved. In addition, in the back plate according to the embodiment, a better appearance can be obtained by using maple having grain as the materials of the veneers which form the front surface plate.

The back plate of the violin according to the embodiment can be manufactured with the same method as the front plate 10 according to the above-described first embodiment.

In addition, with the back plate according to the embodiment, the same effects as the front plate 10 according to the above-described first embodiment can be obtained. That is, the back plate according to the embodiment can be efficiently manufactured and has high material yield. Accordingly, the back plate according to the embodiment has a small variation in density, has partially different thicknesses, has a shape of being curved to be convex toward one surface side, and is superior in acoustic characteristics. In addition, the back plate according to the embodiment is superior in shape stability and has a good appearance.

<Stringed Instrument>

Figure 4:
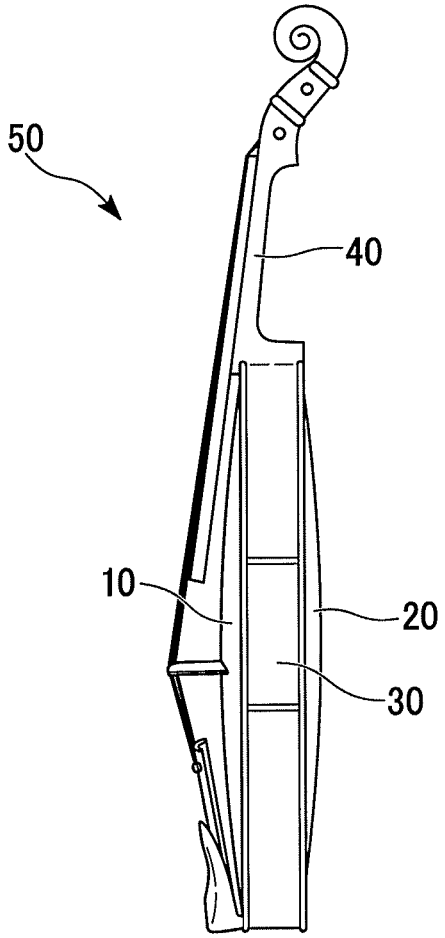
FIG. 4 is a side view showing a violin which is an example of a stringed instrument according to the present invention.

In this embodiment, a violin will be described as an example of a stringed instrument according to the present invention. FIG. 4 is a side view showing a violin which is an example of the stringed instrument according to the present invention.

In FIG. 4, the violin 50 includes a front plate 10, a back plate 20, a side plate 30, and a neck 40.

In the violin 50 shown in FIG. 4, the front plate according to the first embodiment is used as the front plate 10. In the front plate 10 shown in FIG. 4, a f-hole (not shown) is formed at a predetermined position of the front plate 10 according to the first embodiment.

In the violin 50 shown in FIG. 4, the back plate according to the second embodiment is used as the back plate 20.

The violin 50 can be manufactured with a well-known method of the related art by using the front plate according to the first embodiment as the front plate 10 and using the back plate according to the second embodiment as the back plate 20.

Specifically, the back plate 20 and the side plate 30 are bonded to each other using an adhesive such as glue. Next, the side plate 30 and the front plate 10 are bonded to each other using an adhesive such as glue to form a body. Next, the neck 40 is attached to the body, and the front surface is coated with varnish. Next, a fingerboard is attached, and a sound post is installed. Next, a bridge is installed, and strings are tensed.

Through the above-described processes, the violin 50 shown in FIG. 4 is obtained.

The violin 50 can be manufactured by using the front plate according to the first embodiment as the front plate 10 and using the back plate according to the second embodiment as the back plate 20, and thus has a good appearance and superior acoustic qualities. In addition, the violin 50 is not likely to be damaged by deformation of the front plate 10 and the back plate 20 and thus can be used for a long period of time.

<Other Examples>

The stringed instrument and the board for a stringed instrument according to the present invention are not limited to the above-described embodiments.

For example, the stringed instrument according to the present invention is not limited to a violin and may be a viola, a cello, or a double base belonging to the violin family. In addition, the present invention can also be applied to a stringed instrument, such as a guitar or the like, including a front plate and/or a back plate having a camber shape which is curved to be convex toward one surface side.

In addition, in the above-described example, the core plate 3 of the front plate 10 shown in FIG. 1A includes the three veneers. However, the number of veneers in the core plate 3 may be one, two, four or more and can be determined according to the thicknesses of the veneers which are to form the front surface plate 1, the back surface plate 2, and the core plate 3.

In addition, in the above-described example, the front plate 10 shown in FIG. 1A includes the front surface plate 1 and the back surface plate 2. However, the front surface plate 1 and the back surface plate 2 are not necessarily provided.

In addition, the planar shape and the laminating order of each of the veneers which form the board for a stringed instrument according to the present invention are not limited to the above-described embodiments.

While preferred embodiments of the invention have been described and shown above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A board for a stringed instrument which forms a front plate or a back plate of a stringed instrument, the board comprising:

a laminated plate that is obtained by laminating a plurality of veneers consisting of wood and having a uniform thickness by an adhesive without a gap, at least one of the veneers having a different planar shape than the other veneers, wherein the veneers have fiber directions, the front plate has a length direction, the fiber directions of the veneers are aligned to the length direction of the front plate, and wherein the adhesive contains no solvent, and wherein the laminated plate is curved to be convex toward one surface side and has a thin portion and a thick portion.

2. The board for a stringed instrument according to claim 1, wherein the number of veneers laminated in the thin portion is less than the number of veneers laminated in the thick portion.

3. The board for a stringed instrument according to claim 1, wherein one of the plurality of veneers exposed to the one surface side of the laminated plate covers the entire surface of the laminated plate.

4. A method of manufacturing a board for a stringed instrument which forms a front plate or a back plate of a stringed instrument, the method comprising:

a laminating process of forming a laminate by laminating a plurality of veneers consisting of wood and having a uniform thickness by an adhesive, at least one of the veneers having a different planar shape than the other veneers, wherein the veneers have fiber directions, the front plate has a length direction, the fiber directions of the veneers are aligned to the length direction of the front plate, and wherein the adhesive contains no solvent; and a bending process of obtaining a laminated plate by curving the laminate to be convex toward one surface side and forming a thin portion and a thick portion while maintaining the thickness of each of the plurality of veneers to be constant.

5. A stringed instrument comprising: the board for a stringed instrument according to claim 1.

* * * * *